US007802683B2

(12) United States Patent
Bourque

(10) Patent No.: US 7,802,683 B2
(45) Date of Patent: Sep. 28, 2010

(54) COVER SHEET MEMBER FOR PILL RECEPTACLES AND METHOD OF SEALING A PILL RECEPTACLE WITH A COVER SHEET MEMBER

(75) Inventor: Gilles Bourque, Repentigny (CA)

(73) Assignee: Richards Packaging Inc. (CA)

( * ) Notice: Subject to any disclaimer, the term of this patent is extended or adjusted under 35 U.S.C. 154(b) by 75 days.

(21) Appl. No.: 12/119,645

(22) Filed: May 13, 2008

(65) Prior Publication Data

US 2009/0283438 A1 Nov. 19, 2009

(51) Int. Cl.
*B65D 83/04* (2006.01)

(52) U.S. Cl. ..... 206/539; 206/538; 206/534; 206/528

(58) Field of Classification Search ..... 206/528, 206/531, 532, 534.1, 538, 539, 469
See application file for complete search history.

(56) References Cited

U.S. PATENT DOCUMENTS 3,397,671 A * 8/1968 Hartman, Jr. et al. ..... 206/532
3,715,856 A * 2/1973 Borel ..... 53/487
3,780,856 A * 12/1973 Braverman ..... 206/534
RE29,705 E * 7/1978 Compere ..... 206/531
4,357,192 A * 11/1982 Moser ..... 156/252
4,416,375 A * 11/1983 Braverman et al. ..... 206/534.1
4,429,792 A * 2/1984 Machbitz ..... 206/531
5,791,478 A * 8/1998 Kalvelage et al. ..... 206/531
6,023,916 A * 2/2000 Bouthiette ..... 53/471
6,026,726 A * 2/2000 Bouthiette ..... 83/745
2006/0249421 A1* 11/2006 Pham ..... 206/531
2007/0205131 A1* 9/2007 Bouthiette ..... 206/538
2008/0023366 A1* 1/2008 Bouthiette ..... 206/532

* cited by examiner

*Primary Examiner*—David T Fidei
(74) *Attorney, Agent, or Firm*—Fraser Clemens Martin & Miller LLC; Donald R. Fraser

(57) ABSTRACT

A pill receptacle has a number of recessed pill compartments formed therein. The method comprises the steps of providing a cover sheet member that has a sealing sheet with a top identification surface on which information can be printed and a bottom adhesive surface provided with an adhesive. The cover sheet member further has a protective sheet that removably overlays the sealing sheet on its adhesive surface. First weakness zones are provided on the cover sheet member, that extend transversely through the sealing sheet and the protective sheet in a registering fashion to define first cutaway lines on the cover sheet member. A fraction of the cover sheet member is separated from the rest of the cover sheet member along at least some of the first cutaway lines, including concurrently separating corresponding fractions of the sealing sheet and the protective sheet in registering fashion. The protective sheet fraction is peeled away from the sealing sheet fraction on the cover sheet member fraction. The selected pill compartments are covered and individually sealed by applying the adhesive surface of the sealing sheet fraction on the pill receptacle whereby the adhesive surface of the sealing sheet fraction adheres to the pill receptacle about the pill compartments.

5 Claims, 7 Drawing Sheets

COVER SHEET MEMBER FOR PILL RECEPTACLES AND METHOD OF SEALING A PILL RECEPTACLE WITH A COVER SHEET MEMBER

FIELD OF THE INVENTION

The present invention relates to pill receptacles having recessed pill compartments, and more particularly to a method of sealing selected pill compartments with a fraction of a cover sheet member, to the cover sheet member itself, to a kit comprising a pill receptacle and a cover sheet member and to a method of producing a cover sheet member.

BACKGROUND OF THE INVENTION

Pill containers having recessed pill compartments are well known. These pill containers are used to store and sort pills for patients that are required to take one or more medicated pill types per day. The patients may handle the pill containers themselves or, if they stay in establishments such as medically-supported retirement homes, the medical staff will handle the pill containers to distribute the medication to the patients. A typical pill container will contain a patients pill doses for an entire week.

Pill containers conventionally comprise a pill receptacle which is made from a moulded semi-rigid plastic sheet in which recessed pill compartments are formed. The pill compartments define top mouth openings that are circumscribed by coplanar edges. A single sealing sheet may be applied on the coplanar pill receptacle edges to cover and individually seal the pill compartments. Pills are inserted in the different pill compartments according to doses which are required to be taken at a given time of day before the pill compartments are sealed. Respective pill compartments may correspond to the morning, lunch, supper and bedtime doses, for each day. Since each pill compartment is individually sealed and properly identified, it is clear and easy for the patient or the medical staff to know which pill compartment needs to be accessed for administering medication to a particular patient on a given day and at a given time of day. The pill container will often be designed to further allow each individually sealed pill compartment to be detached from the remaining portion of the pill container. When medical staff needs to distribute only a specific dose of medication at a given time of day, it is possible to simply detach the appropriate pill compartment and give it to the patient who can access the pills by himself.

Cover sheet members are provided that comprise a sealing sheet for use as discussed above and a protective sheet that overlays the sealing sheet. More particularly, the sealing sheet has opposite identification and adhesive surfaces. The former is used to write down medical information, medication information, user identification, date, time of the day at which the pills should be taken, name of the user's pharmacist, name of the prescribing doctor and the like information; while the latter is provided with an adhesive allowing the sealing sheet to adhere to the pill receptacle. The protective sheet overlays the sealing sheet on its adhesive surface to prevent the sealing sheet from accidentally sticking to miscellaneous objects before it is installed. Different types of adhesives may be used on the sealing sheet, including so-called temporary adhesives that allow the sealing sheet to be removed from and re-installed on the pill receptacle if access to the pill compartments is required; and so-called permanent adhesives that have strong enough adhering properties that will prevent the sealing sheet from being removed from the pill receptacle without tearing the sealing sheet apart, once it is installed on the pill receptacle. The latter so-called permanent adhesives are of particular interest for us in this Background of the Invention section and it will be considered from hereon that a permanent adhesive is used unless noted otherwise.

To apply the sealing sheet on the pill receptacle, the protective sheet is first peeled away from the sealing sheet and the sealing sheet may then be applied on the pill receptacle. This is accomplished by aligning the cover sheet member with respect to the pill receptacle with the help of a tray on which the pill receptacle rests. The tray, the pill receptacle and the cover sheet member indeed comprise complementary alignment members that allow the pill receptacle and the cover sheet member to be properly aligned with respect to each other before the protective sheet is removed when they are installed on the tray. These alignment members are found for example in the form of lugs that extend from the tray, these lugs cooperating with holes made in the pill receptacle and the cover sheet member to align the cover sheet member with respect to the pill receptacle. Once this alignment is achieved, the protective sheet is removed and the sealing sheet is applied on the pill receptacle.

Pills are inserted in the pill compartments before the sealing sheet is applied on the pill receptacle.

Some pill receptacles include weakness zones along the edges that circumscribe the pill compartments, to allow the individually sealed pill compartments from being detached from the rest of the pill receptacle. This allows individual medication doses to be distributed to patients instead of providing them with an entire pill container. The weakness zones on the pill receptacle are designed to allow the pill compartments from being easily manually detached by being sheared off from the adjacent pill receptacle portions. The sealing sheet is usually provided with weakness zones also in the form of cutaway lines that correspond to the position of the pill receptacle weakness zones, to allow the sealing sheet to tear cleanly when a pill compartment is detached.

Whether the pill compartments are detachable from the rest of the pill receptacle or not, to retrieve the pills from the sealed pill compartments, the sealing sheet must be pierced above desired pill compartments whereby access to the pills becomes possible. One interest in having the sealing sheet being pierced is that it is easy to visually assess whether the pill receptacle has been accessed or not. This helps prevent patients from voluntarily or involuntarily taking more or less medication than they should.

The sealing sheet may be provided with weakness zones thereon to facilitate a person's finger piercing the sealing sheet above pill compartments. It is known for example to provide a weakness zone in the form of a single central line of perforations in the cover sheet member above each pill compartment. Consequently, it is easier for patients or the medical staff to gain access to the pill compartments. This is especially desirable for patients that have less strength in their fingers or other physically or neurologically related motor disorders that complicate physical motor actions such as forcing their finger through a sealing sheet over a pill compartment. When such a weakness zone is provided, a central hole will be more readily formed through the sealing sheet since the sheet yields at the weakness zone when pressure is applied thereon. The sealing sheet is likely to form inwardly folded flanges once it is thus pierced as the finger pushes the sheet into the pill compartment.

One problem with conventional pill containers such as the one detailed above, relates to replacing sealing sheets. Indeed, pill prescriptions will often change depending on the ever-evolving medical condition of a patient. However, pill containers such as the one discussed above are usually used to prepare pills for an entire week; and moreover it is possible for pharmacists to prepare more than one pill container at a time for a given user, i.e. medication may be prepared several weeks in advance and consequently several pill containers may be prepared in advance.

When a permanent adhesive is used, changing the medication in a pill container means that the sealing sheet above selected pill compartments needs to be pierced to access the pills. If all the pill compartments need to be access, then the entire pill container may be changed: a new pill receptacle and a new cover sheet member will be used. However, if only selected ones of the pill compartments have been accessed and some others remain sealed, after the pills have been changed, the accessed pill compartments need to be sealed once again. This will occur rather frequently as one type of medication among the several found in a pill container, will be changed for the entire week at a given time of day: for example, the "morning" medication will be changed for the entire week. However, for re-sealing the accessed pill compartments, simply adding another sealing sheet above the previous sealing sheet is then not an option since the original sealing sheet remains over the other pill compartments where the medication was not changed, e.g. above the "lunch", "supper" and "bedtime" compartments. This means that the addition of an entire sealing sheet over the original sheet results in some pill compartments being sealed with two stacked sealing sheets. Many patients, especially those with physiologically or neurologically related motor disorders, will be incapable of piercing the two stacked sealing sheets to access the pill compartments.

A few solutions have been proposed when the medical condition of the patient requires part of the pills to be changed in the pill container, none of which have been satisfactory.

One known way to go about changing the pills is first to pierce the sealing sheet over the pill compartments where pills need to be changed as described above, change the pills that need to be changed, and to then install a single adhesive sealing repair tab over the specific pill compartments that have been opened. These tabs usually include a recognizable inscription such as a red line to confirm that the pill compartment has been officially re-sealed after it has been tampered with. It is indeed important for the patients and medical staff to be able to confirm that the pill compartments have been accessed by authorized personnel only.

This method of changing pills is problematic for a few reasons. Firstly, patients may become suspicious when a pill compartments have obviously been opened, even if the official repair tab is recognizable. Secondly, it is tedious to install individual repair tabs on each pill compartment where pills have been changed. This is especially true since medication is usually changed for the entire week at a given time of day, as indicated hereinabove, requiring that repair tabs be installed on seven pill compartments or more. It is recalled that each repair tab must be positioned precisely to avoid partly covering adjacent pill compartments to prevent the repair tab from reinforcing a sealed pill compartment by stacking on top of the sealing sheet: consequently, placing the repair tabs is a meticulous and time-consuming operation. Thirdly, once a repair tab is installed, there can remain underlying flanges of the original sealing sheet that extend partly into the pill compartment and, more importantly, under the new sealing sheet, if the sealing sheet was pierced without substantially conforming to the contour of the pill compartment. These inopportune flanges can support the peripheral edges of the repair tab. This makes it more difficult for a person to break through the repair tab when the medication underneath it needs to be accessed since the repair tab is supported and reinforced by the underlying portions of the sealing sheet flanges about the hole that was made to first access and change the medication in the pill compartment. Patients with physiologically or neurologically related motor disorders are sometimes incapable of piercing such an undesirably reinforced repair tab.

An alternate known method for changing the pills in a sealed pill container includes cutting open with a knife the bottom wall, opposite the top mouth opening, of each pill compartment where pills need to be changed. This forms bottom openings in the pill compartments while the top openings remain sealed with the sealing sheet. It is then possible to change the pills in the pill compartments through the bottom wall openings and seal the bottom wall openings with an officially recognizable repair tab. The problems noted above are also true for this alternate method of changing the pills, except that the repair tab needs not be pierced to access to the pills in the pill compartments. Indeed, ulterior access by the patient or medical staff to the pills will conventionally be through the sealing sheet that covers the top mouth openings of the pill compartments. It will not be more difficult to gain access to the pills since the user needs not force through a repair tab reinforced by underlying sealing sheet flanges. However, while this latter problem is solved, the other above-noted problems remain and another is created: it is yet more complex and time consuming to change the pills, requiring dedicated equipment to do so: knife and a cutting frame are provided for this purpose, the cutting frame having a slot that can be engaged by the knife to cut the bottom wall off the required pill compartments without cutting the entire pill compartment off.

SUMMARY OF THE INVENTION

The present invention relates to a method of sealing selected pill compartments of a pill receptacle having a number of recessed pill compartments formed therein, said method comprising the steps of:

providing a cover sheet member comprising a sealing sheet with a top identification surface on which information can be printed and a bottom adhesive surface provided with an adhesive, said cover sheet member further comprising a protective sheet that removably overlays said sealing sheet on its adhesive surface;

providing first weakness zones on said cover sheet member that extend transversely through said sealing sheet and said protective sheet in a registering fashion to define first cutaway lines on said cover sheet member;

separating a fraction of said cover sheet member from the rest of said cover sheet member along at least some of said first cutaway lines, including concurrently separating corresponding fractions of said sealing sheet and said protective sheet in registering fashion;

peeling said protective sheet fraction away from said sealing sheet fraction on said cover sheet member fraction; and covering and individually sealing said selected pill compartments by applying said adhesive surface of said sealing sheet fraction on said pill receptacle whereby said adhesive surface of said sealing sheet fraction adheres to said pill receptacle about said pill compartments.

In one embodiment, the step of providing first weakness zones on said cover sheet member comprises providing registering perforations respectively located on said sealing sheet and on said protective sheet to define said first cutaway lines on said cover sheet member.

In one embodiment, the method further comprises the step of providing second weakness zones on said cover sheet member that extend transversely through said sealing sheet but not through said protective sheet to define second cutaway lines on said sealing sheet only.

In one embodiment, the step of separating a fraction of said cover sheet member from the rest of said cover sheet member is also accomplished along at least some of said second cutaway lines.

In one embodiment, said pill compartments are disposed in perpendicular rows and columns in said pill receptacle, said first cutaway lines are parallel to one another, said second cutaways lines are parallel to one another and perpendicular to said first cutaway lines and the step of covering and individually sealing said selected pill compartments by applying said adhesive surface of said sealing sheet fraction on said pill receptacle includes positioning said sealing sheet fraction relative to said pill receptacle so that said first cutaway lines will extend between at least some of said columns and said second cutaway lines will extend between at least some of said rows.

In one embodiment, the method further comprises the step of providing third weakness zones on said cover sheet member, wherein the step of covering and individually sealing said selected pill compartments by applying said adhesive surface of said sealing sheet fraction on said pill receptacle includes positioning said sealing sheet fraction relative to said pill receptacle so that said third weakness zones will overlie said selected pill compartments, said third weakness zones facilitating access to said selected pill compartments by facilitating bursting through said sealing sheet fraction.

In one embodiment, said third weakness zones define third cutaway lines forming closed loops that will each substantially register with a peripheral edge portion of a corresponding said pill compartment when said third weakness zones overlie said selected pill compartments.

In one embodiment, said third weakness zones further defining a pair of fourth cutaway lines located within said closed loops.

In one embodiment, the method further comprises the step of providing fifth cutaway lines that define protective tabs made in said protective sheet, wherein during the step of peeling said protective sheet fraction away from said sealing sheet fraction, said protective tabs remain on said sealing sheet adhesive surface and during the step of covering and individually sealing said selected pill compartments by applying said adhesive surface of said sealing sheet fraction on said pill receptacle, said protective tabs become aligned with said selected number of pill compartments so as to prevent said sealing sheet adhesive surface from being exposed in said selected pill compartments.

In one embodiment, before the step of covering and individually sealing said selected pill compartments by applying said adhesive surface of said sealing sheet fraction on said pill receptacle, said method comprising the step of aligning said cover sheet member with respect to said pill receptacle with a tray comprising alignment members that are complementary to alignment members provided on said pill receptacle and said cover sheet member.

In one embodiment, the step of aligning said cover sheet member with respect to said pill receptacle includes engaging lugs that project from said tray in holes formed in said pill receptacle and in said cover sheet member.

In one embodiment, the step of providing a cover sheet member includes printing information on said top identification surface of said sealing sheet, said information including at least one of medical information, medication information, user identification, date, time of the day at which the pills should be taken, name of the user's pharmacist and name of the prescribing doctor.

In one embodiment, said cover sheet member comprises a header portion separated from said first cutaway lines by one of said second cutaway lines.

The present invention also relates to a method of changing pills in and re-sealing a pill container, said pill container comprising a pill receptacle having a number of recessed pill compartments formed therein with at least some of said pill compartments holding pills and being partly sealed with a first sealing sheet which is affixed to said pill receptacle so as to form originally sealed pill compartments, said method comprising the steps of:

changing pills in selected pill compartments which are not covered by said first sealing sheet;

providing a cover sheet member comprising a second sealing sheet with a top identification surface on which information can be printed and a bottom adhesive surface provided with an adhesive, said cover sheet member further comprising a protective sheet which overlays said second sealing sheet on its adhesive surface;

providing first weakness zones on said cover sheet member that extend transversely through said second sealing sheet and said protective sheet in a registering fashion to define first cutaway lines on said cover sheet member;

separating a fraction of said cover sheet member from the rest of said cover sheet member along at least some of said first cutaway lines, including concurrently separating corresponding fractions of said second sealing sheet and said protective sheet in registering fashion;

peeling said protective sheet fraction away from said second sealing sheet fraction on said cover sheet member fraction; and covering and individually sealing said selected pill compartments by applying said adhesive surface of said sealing sheet fraction on said pill receptacle whereby said adhesive surface of said sealing sheet fraction adheres to said pill receptacle about said pill compartments.

In one embodiment, the method further comprises, before the step of changing pills in selected pill compartments, the step of piercing said first sealing sheet over a number of originally sealed pill compartments so as to allow access therein, thereby forming at least some of said selected pill compartments.

The present invention farther relates to a cover sheet member for use with a pill receptacle having a number of recessed pill compartments, said cover sheet member defining peripheral edges and comprising:

a sealing sheet with a top identification surface on which information can be printed and a bottom adhesive surface provided with an adhesive;

a protective sheet which overlays said sealing sheet on its adhesive surface;

first weakness zones that extend transversely through said sealing sheet and said protective sheet in a registering fashion to define first cutaway lines that are parallel to one another;

second weakness zones that extend transversely through said sealing sheet but not through said protective sheet to define second cutaway lines that are parallel to one another; wherein said first and second cutaway lines are disposed perpendicularly to form rows between consecutive said second cutaway lines and between some of said second cutaway lines and some of said cover sheet member peripheral edges; and columns between consecutive said first cutaway lines and between some of said first cutaway lines and some of said cover sheet member peripheral edges; wherein said protective sheet may be peeled away from said sealing sheet for applying said sealing sheet on said pill receptacle to cover and individually seal said number of pill compartments; and wherein alternately a fraction of said cover sheet member can be separated from the rest of said cover sheet member along at least some of said first cutaway lines, including concurrently separating corresponding fractions of said sealing sheet and said protective sheet in registering fashion, whereby said protective sheet fraction may be peeled away from said sealing sheet fraction on said cover sheet member fraction for applying said sealing sheet fraction on said pill receptacle for covering and individually sealing selected ones of said number of pill compartments.

In one embodiment, said cover sheet member further comprises a header portion separated from said first cutaway lines by one of said second cutaway lines and being circumscribed by said one of said second cutaway lines and by at least some of said cover sheet member peripheral edges.

The present invention also relates to a kit for sorting and containing pills, comprising a pill receptacle having a number of recessed pill compartments formed therein and a cover sheet member defining peripheral edges and comprising:

a sealing sheet with a top identification surface on which information can be printed and a bottom adhesive surface provided with an adhesive;

a protective sheet which overlays said sealing sheet on its adhesive surface;

first weakness zones that extend transversely through said sealing sheet and said protective sheet in a registering fashion to define first cutaway lines that are parallel to one another;

second weakness zones that extend transversely through said sealing sheet but not through said protective sheet to define second cutaway lines that are parallel to one another; wherein said first and second cutaway lines are disposed perpendicularly to form rows between consecutive said second cutaway lines and between some of said second cutaway lines and some of said cover sheet member peripheral edges; and columns between consecutive said first cutaway lines and between some of said first cutaway lines and some of said cover sheet member peripheral edges; wherein said protective sheet may be peeled away from said sealing sheet to apply said sealing sheet on said pill receptacle to cover and individually seal said number of pill compartments; and wherein alternately a fraction of said cover sheet member can be separated from the rest of said cover sheet member along at least some of said first cutaway lines, including concurrently separating corresponding fractions of said sealing sheet and said protective sheet in registering fashion, whereby said protective sheet fraction may be peeled away from said sealing sheet fraction on said cover sheet member fraction to apply said sealing sheet fraction on said pill receptacle to cover and individually seal selected ones of said number of pill compartments.

In one embodiment, the kit further comprises an additional cover sheet member similar to the first-named said cover sheet member.

The present invention further relates to a method of producing a cover sheet member defining peripheral edges and comprising the following steps:

providing a sealing sheet with a top identification surface on which information can be printed and a bottom adhesive surface provided with an adhesive;

providing a protective sheet;

overlaying said protective sheet on said sealing sheet adhesive surface;

forming first weakness zones that extend transversely through said sealing sheet and said protective sheet in a registering fashion to define first cutaway lines that are parallel to one another;

forming second weakness zones that extend transversely through said sealing sheet but not through said protective sheet to define second cutaway lines that are parallel to one another; wherein said first and second cutaway lines are disposed perpendicularly to form rows between consecutive said second cutaway lines and between some of said second cutaway lines and some of said cover sheet member peripheral edges; and columns between consecutive said first cutaway lines and between some of said first cutaway lines and some of said cover sheet member peripheral edges.

BRIEF DESCRIPTION OF THE DRAWINGS

In the annexed drawings:

FIG. 7 is an exploded perspective view of the sealed pill receptacle of FIG. 6 which is installed on the tray of FIG. 1 with the sealing sheet above the leftmost column of pill compartments having been pierced to allow access to the pills therein, FIG. 7 further showing a new cover sheet member which is fragmented into a new cover sheet member fraction which is to be applied to re-seal the pill compartments above which the sealing sheet has been pierced and a new cover sheet member disposable portion which will be disposed of.

DETAILED DESCRIPTION OF THE EMBODIMENTS

Figure 1:
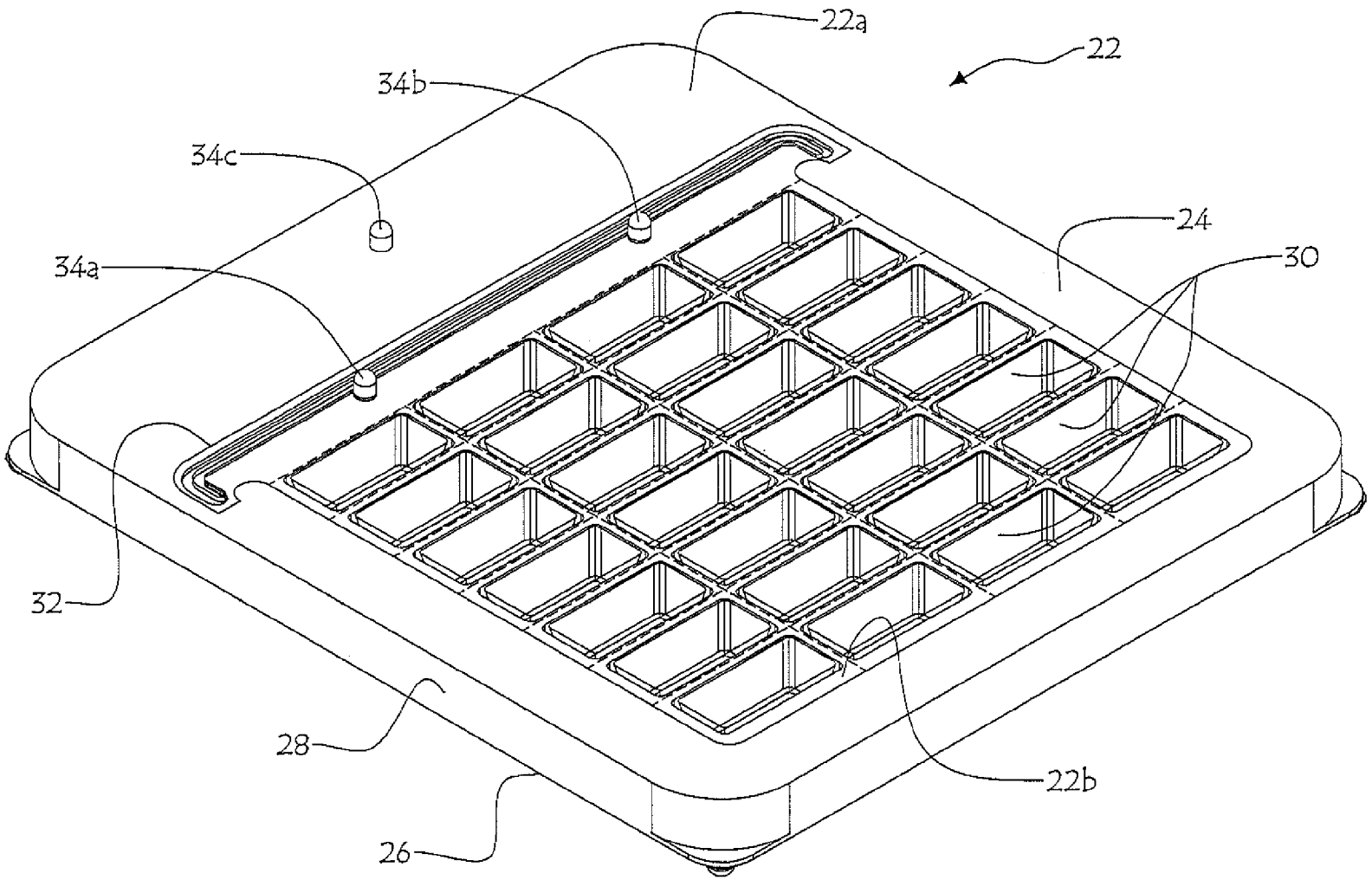
FIG. 1 is a perspective view of a tray which is part of a kit for sorting and containing pills according to the present invention.

FIGS. 1-7 show in whole or in part a kit 20 for sorting and containing pills, that comprises a tray 22 shown alone in FIG. 1. Tray 22 has a head portion 22*a*, a recessed portion 22*b*, opposite top and bottom surfaces 24, 26 and a peripheral side surface 28. Tray 22 comprises a number of recesses 30 in its recessed portion 22*b* with top mouth openings that are oriented towards the top surface 24 of tray 22. Alignment members in the form of a groove 32 and lugs 34*a*, 34*b*, 34*c* (collectively referred to as lugs 34) are integrally formed in and project from the top surface 24 of tray 22 in its head portion 22*a*. Tray 22 may be made from any suitable material, for example rigid plastic.

Figure 2:
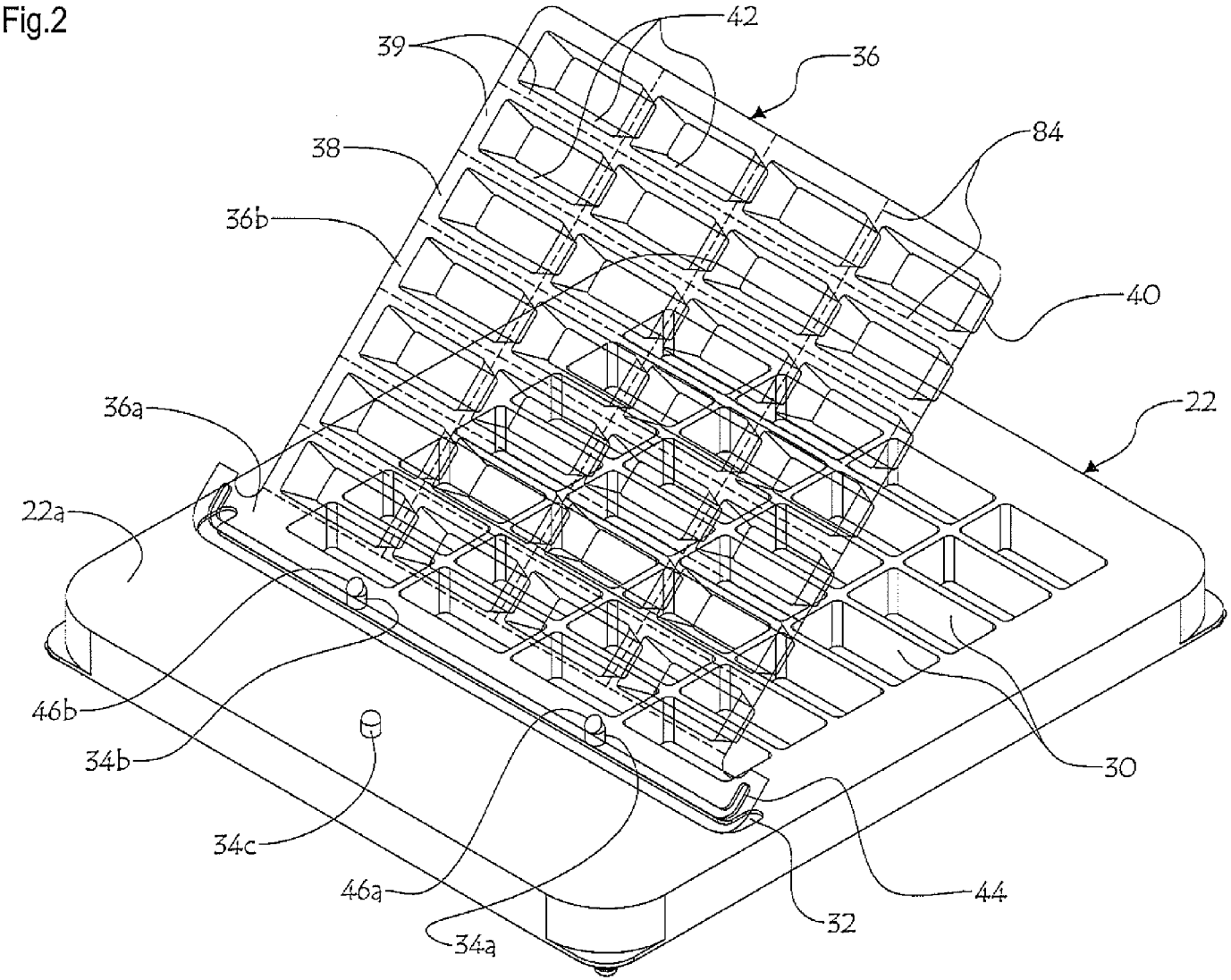
FIG. 2 is a perspective view of the tray of FIG. 1 on which a transparent pill receptacle is being installed, the pill receptacle being shown in a tilted position before it finally comes to rest atop the tray.

FIGS. 1-6, and in particular FIG. 2, show that kit 20 further comprises a pill receptacle 36 that can be made of any suitable material such as a preformed semi-rigid transparent plastic sheet. Pill receptacle 36 has a main recessed portion 36*b* bordered by an upper marginal edge portion 36*a* and top and bottom surfaces 38, 40. Pill receptacle comprises a number of recessed pill compartments 42 formed in its recessed portion 36*b*. Pill compartments 42 have top mouth openings is that are oriented towards the top surface 38 of pill receptacle 36. The top mouth openings of pill receptacle 36 are circumscribed by edges 39 coplanar to each other.

Pill compartments 42 are of a shape, size and configuration that allow them to fit into corresponding recesses 30 in tray 22 when pill receptacle 36 is installed with its bottom surface 40 resting on the top surface 24 of tray 22. In the embodiment shown in the drawings, the number of recesses 30 in tray 22 corresponds to the number of pill compartments 42 in pill receptacle 36. Also, pill compartments 42 are arranged in perpendicular rows and columns, as are recesses 30 in tray 22.

Figure 3:
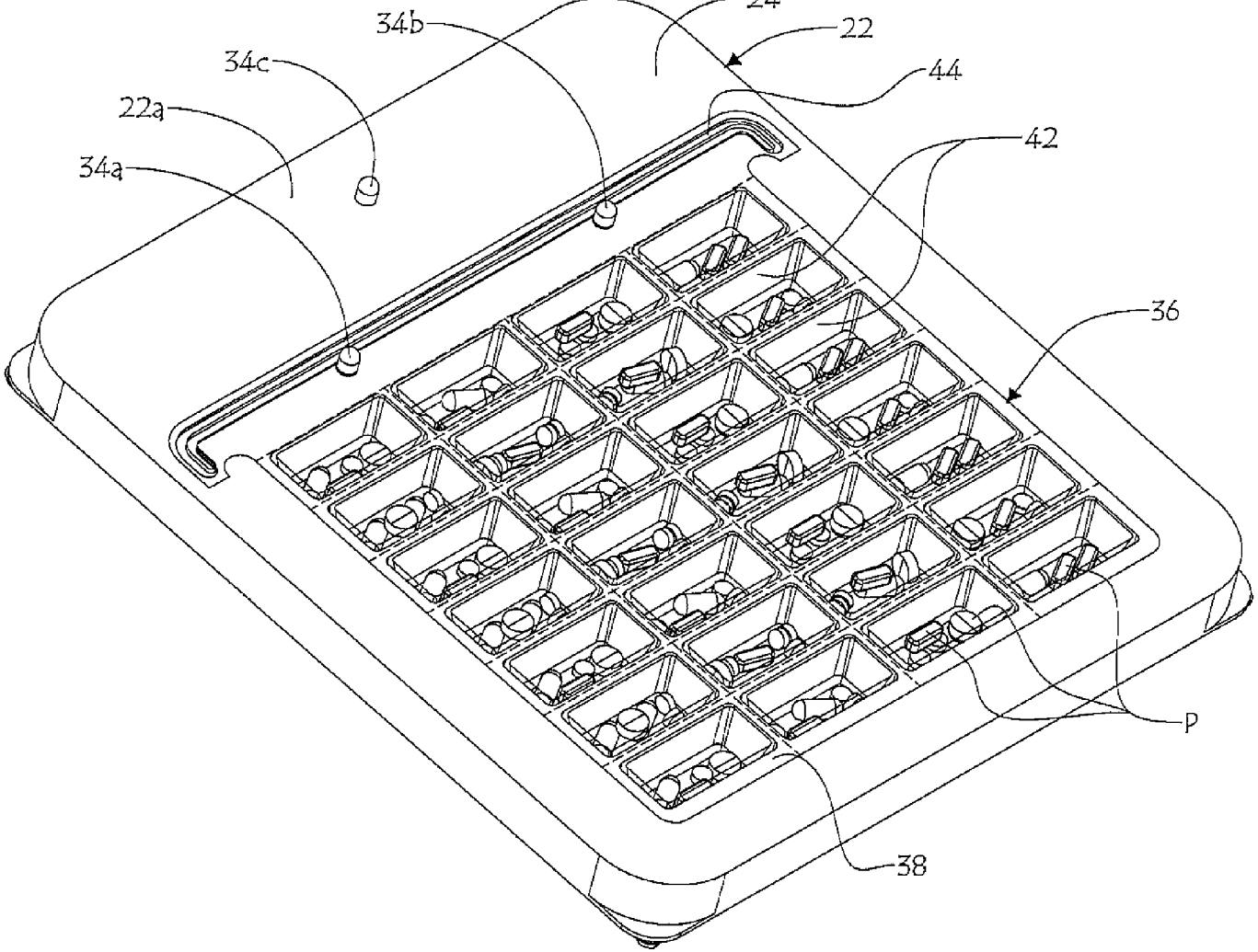
FIG. 3 is a perspective view of the tray and pill receptacle of FIG. 2, with the pill receptacle resting atop the tray in an operative position, and further showing pills in the pill compartments of the pill receptacle.

The engagement of pill compartments 42 in recesses 30 is facilitated by providing complementary alignment members on tray 22 and on pill receptacle 36. More particularly, an alignment member in the form of a rib 44 on pill receptacle marginal edge portion 36*a* can fit into and engage a complementary alignment member in the form of groove 32 in tray 22 when pill receptacle 36 is installed atop tray 22. Additional alignment members in the form of a pair of holes 46*a*, 46*b* (collectively referred to as holes 46) can be engaged by complementary alignment members in the form of lugs 34*a*, 34*b* of tray 22 (FIGS. 2 and 3).

It is consequently possible to install pill receptacle 36 on tray 22 in a very stable manner, by using the complementary alignment members 32, 34, 44, 46 to properly align pill receptacle 36 with respect to tray 22, thus allowing the pill compartments 42 to fit into corresponding recesses 30 in tray 22 when pill receptacle 36 rests atop tray 22.

Pills P, which may include pills of varying nature and even medication in other forms as will be obvious for someone skilled in the art, may then be inserted into the different pill compartments 42. In the example shown in the drawings, pill receptacle 36 includes seven rows that are each destined to represent one day of the week, for example from Sunday to Saturday; and four columns that are each destined to represent one time of the day at which medication is to be taken, for example morning, lunch, supper and bedtime. Thus, a pharmacist who inserts pills P in pill receptacle 36 will distribute pills P in each pill compartment according to the time of day at which the medication is to be taken. Also, it is likely that pill compartments 42 of a same column will contain the same pills since it is usual for patients to take pills of a given type every day at a given time of day. For example, if a patient takes a particular pill every morning, then one such pill will be inserted into each pill compartment 42 of the leftmost column of pill receptacle 36. The pills are thus distributed in all predetermined pill compartments 42. Note that some pill compartments may remain empty, for example if a patient takes not pills at bedtime, then the rightmost column of pill compartments 42 will remain empty.

Figure 4:
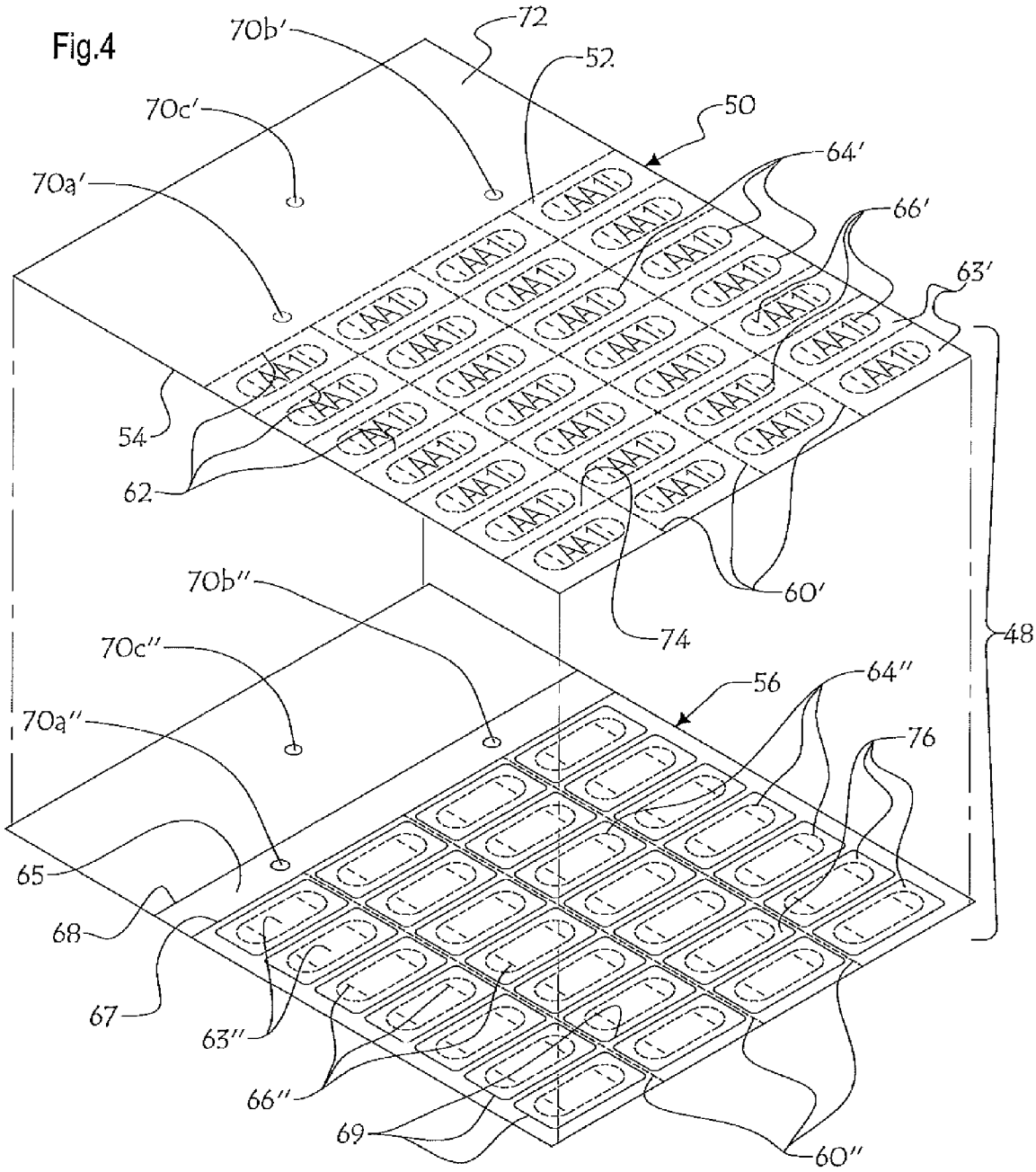
FIG. 4 is an exploded perspective view of a cover sheet member which is part of the kit for sorting and containing pills according to the present invention.
Figure 5:
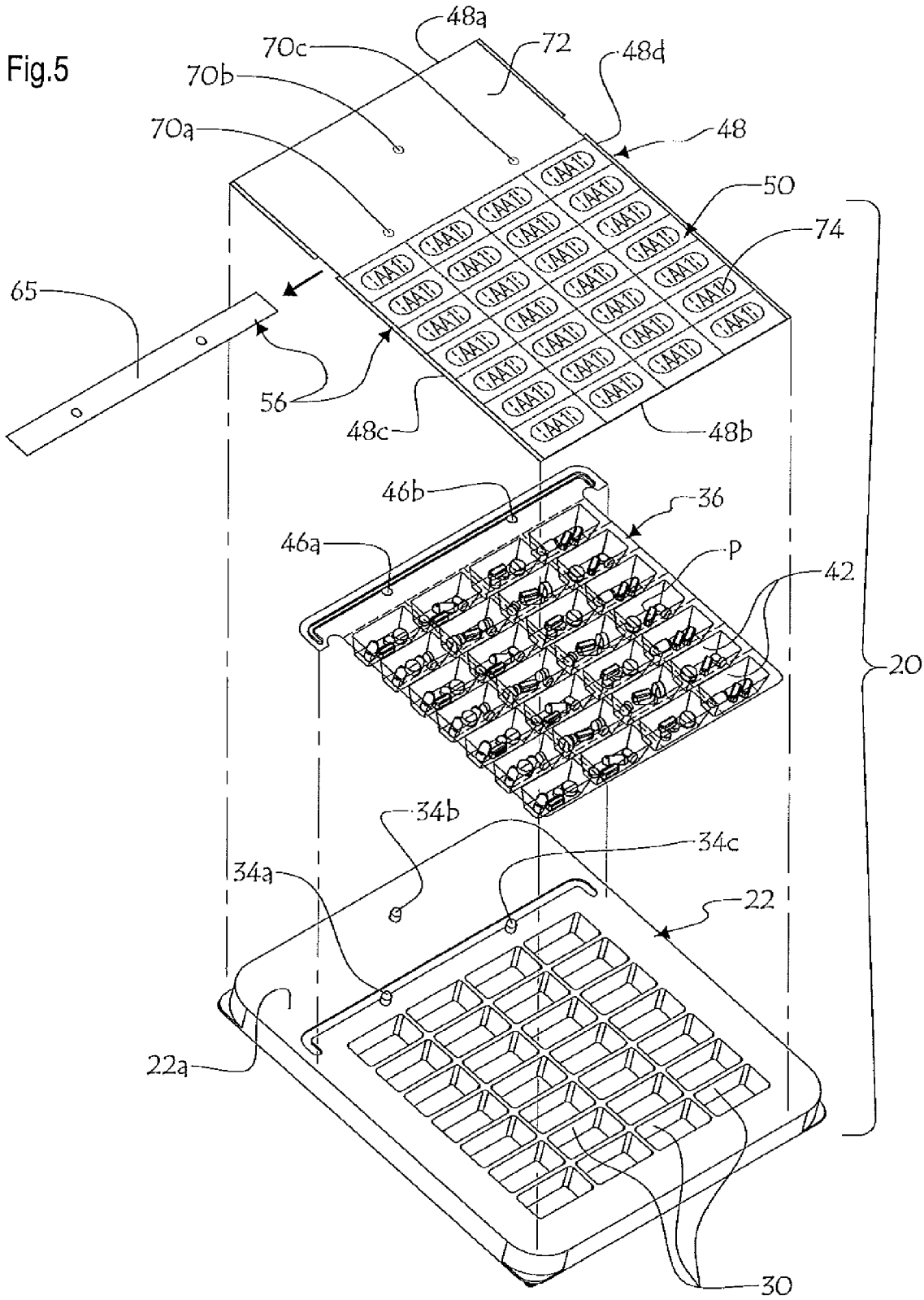
FIG. 5 is an exploded perspective view, at a smaller scale, of the kit for sorting and containing pills according to the present invention, including the tray and pill receptacle of FIG. 2 together with the cover sheet member of FIG. 4.
Figure 6:
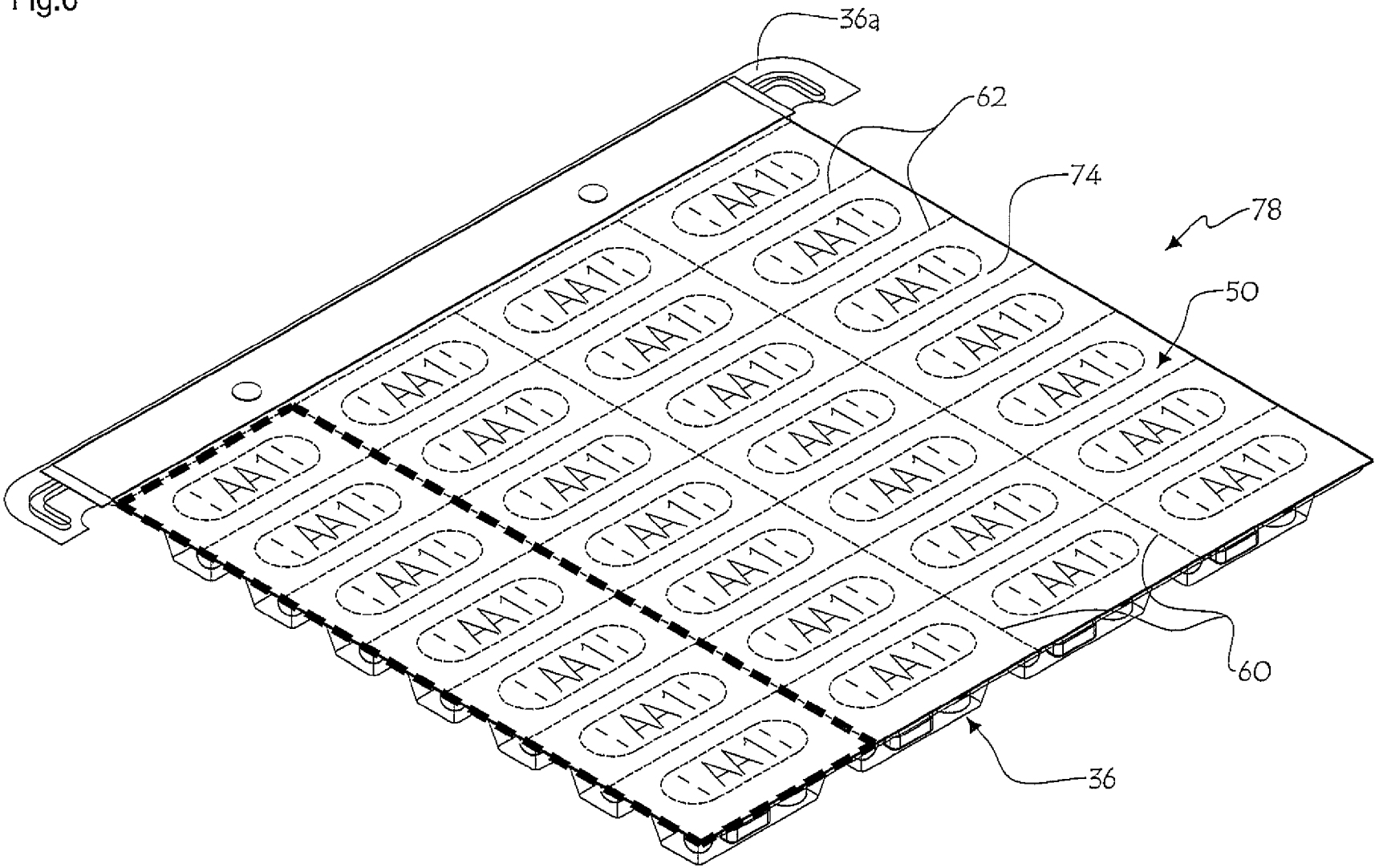
FIG. 6 is a perspective view of a sealed pill receptacle containing pills, with the leftmost column of pill compartments being identified with a peripheral dotted line.

According to the present invention, kit 20 further comprises a cover sheet member 48 shown in FIGS. 4-6 and shown alone in FIG. 4. Cover sheet member 48 has peripheral edges that include an upper edge 48*a*, a lower edge 48*b* and side edges 48*c*, 48*d* (FIG. 5). Cover sheet member 48 comprises a sealing sheet 50 with a top identification surface 52 on which information can be printed and a bottom adhesive surface 54 provided with a permanent adhesive. Cover sheet member 48 further comprises a protective sheet 56 which overlays sealing sheet 50 on its adhesive surface 54. The material used for protective sheet 56 will be a material that allows it to be peeled away from sealing sheet 50 even though it overlays and is applied against the adhesive-covered adhesive surface 54 of sealing sheet 50, as known in the art. This is true even if the adhesive is a permanent adhesive. Also, protective sheet 56 is of a dimension which is slightly larger than that of sealing sheet 50 to form edgewise projection to facilitate protective sheet 56 being individually grasped to peel it off.

Cover sheet member 48 comprises first weakness zones that extend transversely through sealing sheet 50 and protective sheet 56 in a registering fashion to define vertical first cutaway lines 60', 60" (collectively referred to as vertical first cutaway lines 60) that are parallel to one another. Reference to horizontal and vertical orientations are made herein in reference to the conventional orientation associated to the rectangular shape of the cover sheet member 48 where the vertical orientation is defined as parallel to the longer side edges 48*c*, 48*d* of the rectangular cover sheet member 48 while the horizontal orientation is defined as parallel to the shorter upper and lower edges 48*a*, 48*b* of the rectangular sheet member 48. Cutaway lines 60' are located on sealing sheet 50 while cutaway lines 60" are located on protective sheet 56 and each register with a corresponding cutaway line 60'.

Cover sheet member 48 further comprises second weakness zones that extend transversely through sealing sheet 50 but not through protective sheet 56 to define horizontal second cutaway lines 62 that are parallel to one another and perpendicular to the vertical first cutaway lines 60.

Columns are defined between each two consecutive vertical first cutaway lines 60 and between side edges 48*c*, 48*d* and the adjacent first cutaway lines 60; and rows are defined between each two consecutive horizontal second cutaway lines 62 and between lower edge 48*b* and the adjacent horizontal second cutaway line 62. Cover sheet member cells 63', 63" (collectively referred to as cells 63) are defined at each column and row intersection, with cells 63' being located on sealing sheet 50 while cells 63" are located on protective sheet 56 and each register with a corresponding cell 63'. It is noted that even though second cutaway lines 62 are located exclusively on sealing sheet 50, cells 63" are defined on protective sheet 56 according to the registering position of second cutaway lines 62 on protective sheet 56 when sealing sheet 50 and protective sheet 56 are assembled.

Cover sheet member 48 also comprises third weakness zones that extend transversely through sealing sheet 50 and protective sheet 56 in a registering fashion to define third cutaway lines 64', 64" (collectively referred to as third cutaway lines 64) forming closed loops. Each third cutaway line 64 is located within a cell 63. The third weakness zones further define fourth cutaway lines 66', 66" (collectively referred to as fourth cutaway lines 66) located within the closed loops formed by third cutaway lines 64. Fourth cutaway lines 66 are in the form of two short spaced-apart vertical lines that each extends short of the periphery of the third cutaway lines 64 that circumscribes them. Third cutaway lines 64' and fourth cutaway lines 66' are located on sealing sheet 50 while third cutaway lines 64" and fourth cutaway lines 66" are located on protective sheet 56. Each third cutaway line 64' registers with a corresponding third cutaway line 64" and each fourth cutaway line 66' registers with a corresponding fourth cutaway line 66".

In the embodiment shown in the drawings, the first and third weakness zones are perforations that extend through both sealing sheet 50 and protective sheet 56. The second weakness zones are perforations that extend through sealing sheet 50 but not through said protective sheet 56. The perforations shown are elongated and regularly spaced-apart (and thus should not be confused with dotted lines in the annexed drawings), but any other suitable shape or configuration could also be envisioned such as small, round punch-through holes or the like.

Cover sheet member 48 further comprises fourth weakness zones that extend transversely through protective sheet 56 only and not through sealing sheet 50 to define horizontal fifth and sixth cutaway lines 67, 68 that are parallel to the above-mentioned horizontal second cutaway lines 62 albeit not on the same sheet. The position of fifth cutaway line 67 preferably does not register with that of the uppermost second cutaway line 62 when sealing 50 and protective sheet 56 are assembled. A removable protective strip 65 is defined between horizontal fifth and sixth cutaway lines 67, 68 on protective sheet 56.

Cover sheet member 48 also comprises fifth weakness zones that extend transversely through protective sheet 56 only but not through sealing sheet 50 to define seventh cut-away lines 69 that form closed loops each located within a cover sheet member cell and around one of the afore-mentioned third cut-away lines 64" that also form closed loops albeit of smaller size.

Both the fifth, sixth and seventh cutaway lines 67, 68, 69 are continuous instead of being formed of spaced apart perforations as per the first, second, third and fourth cutaway lines. These continuous cuts will facilitate the portions of the protective sheet 56 on either side of such a cut from being separated; and more specifically when one portion on one side of a continuous cutaway line 67, 68, 69 is peeled away, the other portion on the opposite side of the cut will remain attached to the sealing sheet adhesive surface 54, as described hereinafter. For example, protective strip 65 may be peeled off without the remaining portions of protective sheet 56 being carried with it.

Cover sheet member 48 further comprises alignment members in the form of holes 70*a*', 70*a*", 70*b*', 70*b*" and 70*c*', 70*c*" (collectively referred to as holes 70) that are punched through sealing sheet 50 in the case of holes 70*a*', 70*b*' and 70*c*' and through protective sheet 56 in the case of holes 70*a*", 70*b*" and 70*c*". Hole 70*a*' registers with hole 70*a*" (and are collectively referred to as holes 70*a*), hole 70*b*' registers with hole 70*b*" (and are collectively referred to as holes 70*b*) and hole 70*c*' registers with hole 70*c*" (and are collectively referred to as holes 70*c*).

Cover sheet member 48 defines a header portion 72 on one side of the uppermost horizontal second cutaway line 62 where holes 70 are located; and a cell portion 74 which is defined on the other side of the uppermost horizontal second cutaway line 62 where the cover sheet member cells 63 are located.

Information may be printed on the identification surface of sealing sheet 50. This information may include medical information, medication information, user identification, date, time of the day at which the pills should be taken, name of the user's pharmacist and name of the prescribing doctor; together with any other desired information. Some of this information will be summarized in each cover sheet member cell 63 (see FIGS. 5-8) while some information may be provided in more detail in the header portion 72 of sealing sheet 50. It is practical for pharmacists to use convention laser or inkjet office printers to print information on cover sheet member 48.

Cover sheet member 48 is used to cover and individually seal each pill compartment 42 of pill receptacle 36 after the pills are inserted in pill receptacle 36. The adhesive surface 54 of sealing sheet 50 is partly exposed during the process to adhere to the pill receptacle 36 to serve this purpose, as described hereinafter. Before sealing sheet 50 is applied to pill receptacle 36, protective sheet 56 overlays the sealing sheet adhesive surface 54 to avoid accidental adherence thereof to miscellaneous objects.

After pills P are inserted into pill receptacle 36, protective strip 65 is peeled away from sealing sheet 56. Since strip 65 is bordered by the two continuous fifth and sixth cutaway lines 67, 68, removal of strip 65 meets little resistance. The exposed portion of the adhesive surface 54 of sealing sheet 50, namely the portion that has been uncovered by removing strip 65, is then applied against the marginal edge portion 36*a* of pill receptacle 36 and adheres thereto. This latter operation is facilitated by cover sheet member 48 being properly aligned with pill receptacle 36, by means of the complementary alignment members provided on tray 22, pill receptacle 36 and cover sheet member 48. More particularly, as shown in FIG. 5, the holes 46*a*, 46*b* of pill receptacle 36 engage the two lugs 34*a*, 34*b* of tray 22; and the holes 70*a*, 70*b*, 70*c* of cover sheet member 48 engage the three lugs 34*a*, 34*b*, 34*c* of tray 22. This is done with pill receptacle 36 being first installed on tray 22 as shown in FIG. 3 and as described hereinabove; and cover sheet member 48 then being installed over pill receptacle 36 with its protective sheet 56 facing towards pill receptacle 36 and with the identification surface 52 of its sealing sheet 50 being upwardly oriented to apply the exposed portion of adhesive surface 54 against pill receptacle marginal edge portion 36*a*.

From then on, with cover sheet member 48 being attached to pill receptacle 36 along its marginal edge portion 36*a*, cover sheet member 48 will remain aligned with respect to pill receptacle 36, while access to pill compartments 42 remains possible by lifting the cover sheet member cell portion 74. Verification of the content of pill compartments 42 may be accomplished by the pharmacist before pill compartments 42 are definitively sealed.

The cell portion 74 of protective sheet 56 is then peeled away from sealing sheet 50 for applying sealing sheet 50 on the coplanar edges 39 of the top mouth openings of pill compartments 42. This will allow sealing sheet 50 to cover and individually seal each pill compartment 42 after pills P have been inserted in pill receptacle 36. This is made possible while cover sheet member 48 remains linked to pill receptacle 36 by means of its adherence to the pill receptacle marginal edge portion 36*a*. More particularly, the cell portion 74 may be lifted to allow manual access to protective sheet 56. Then, the cell portion 74 of protective sheet 56 may be peeled away to expose the underlying adhesive surface 54 of sealing sheet 50. With sealing strip 65 which has already been removed, when the cell portion 74 of protective sheet 56 is peeled away, the protective sheet header portion 72 will remain attached to sealing sheet 50 above sixth cutaway line 68. The header portion 72 of protective sheet 50 will consequently not accidentally stick to the tray head portion 22*a*.

Furthermore, as the cell portion 74 of protective sheet 56 is peeled away, the continuous seventh cutaway lines 69 will allow protective tabs 76 to separate from the rest of the cell portion 74 of protective sheet 56 to remain attached to sealing sheet 50. Protective tabs 76 are formed by the portions of protective sheet 56 located within seventh cutaway lines 69 that form closed loops.

Sealing sheet 50 will then have part of the cell portion 74 of its adhesive surface 54 exposed, namely the entire cell portion 74 thereof except for that which is covered by protective tabs 76. Sealing sheet may thus be applied against pill receptacle 36, and more particularly the exposed parts of its adhesive surface 54 will adhere to the edges 39 that circumscribe the top mouth openings of pill compartments 42 to cover and individually seal each pill compartment 42. The protective tabs 76 will cover the sealing sheet adhesive surface 54 over every pill compartment 42 for preventing the adhesive surface 54 from being exposed in pill compartments 42.

Pill receptacle 36 and cover sheet member 48, now attached to each other, may then be removed from tray 22. The header portion 72 of cover sheet member 48 above sixth cutaway line 68 may be removed from the remaining portion of the cover sheet member 48 by tearing cover sheet member 48 along the pill receptacle marginal edge portion 36*a*. A sealed pill receptacle 78 is obtained as shown in FIG. 6. It is noted that although sealing sheet 50 does not have a cutaway line at the pill receptacle marginal edge portion 36*a* position, the tearing of sheet 48 is facilitated by using the upper edge of pill receptacle marginal edge portion 36*a* to tear off the header portion 72 of cover sheet member 48 beyond pill receptacle marginal edge portion 36*a*.

A person may manually access pills P in the sealed pill receptacle 78 by piercing the sealing sheet above selected pill compartments 42 by forcing his finger through the sealing sheet and the underlying protective tabs 76. The latter offer marginal resistance at best since they do not adhere to pill receptacle 36. In any event, the fourth cutaway lines 66 help the user burst through sealing sheet 50 and protective tab 76 by locally weakening sealing sheet 50 and protective tab 76. Moreover, it is possible to remove the entire cover sheet member portion above a given pill compartment 42 with the help of the third cutaway lines 64 that allow an elongated sheet portion to be removed, the shape of which generally corresponds to the contour of the underlying pill receptacle 42. The shape of the third cutaway lines 64 can be slightly different than the contour of the underlying pill receptacle 42, for example as shown in the drawings where rectangular pill compartments 42 underlie ovoid third cutaway lines 64. However, having approximately the same shape allows approximately the entire pill receptacle 42 top mouth opening from being cleared when the sealing sheet 50 above a given pill receptacle 42 is pierced.

Sealing sheet 50 will be pierced by patients, with or without the help of medical staff, to access pills P in determined pill compartments 42. The pill compartment 42 to be access is easily determined due to the data printed on the sealing sheet identification surface 52

One reason to pierce sealing sheet 50 above selected pill compartments 42 is to change pills P therein. In the present specification, changing pills P means either inserting one or more pills into an empty pill compartment 42, removing one or more pills from a pill compartment 42 without adding new pills, or both removing one or more pills and adding one or more pills into a pill compartment 42. The medical staff, and more particularly a pharmacist, is usually responsible for changing pills in a pill receptacle 36. As noted in the Background of the Invention section, changing pills can be done for example as a result of a patient's evolving medical condition which requires the medication to also evolve accordingly.

Figure 7:
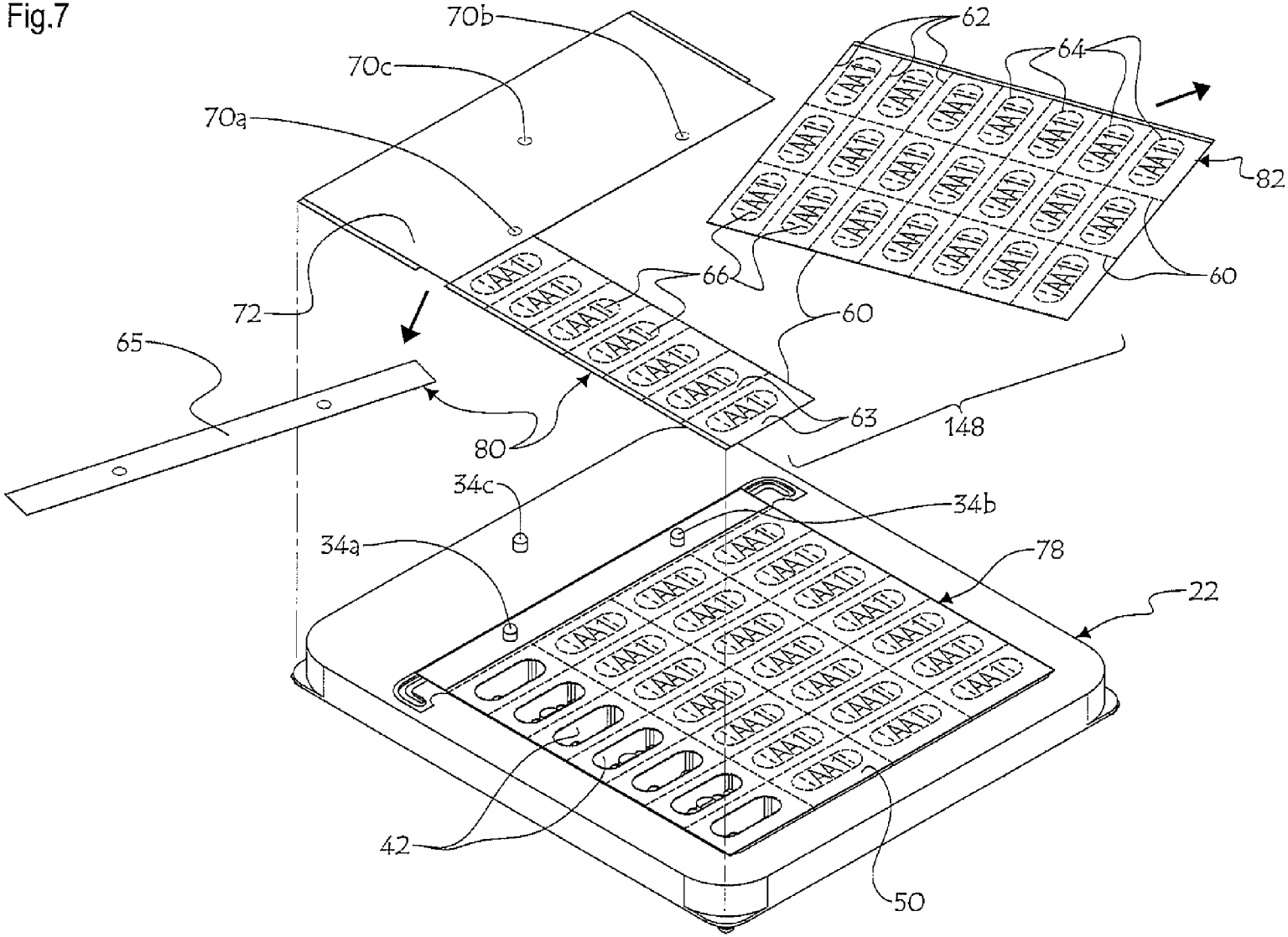

Changing pills is often accomplished by changing all pills taken at a given time of day, for example all pills taken in the morning. Pills compartments 42 for morning pills are represented by the leftmost column of pill compartments 42 in the annexed drawings, as suggested in dotted lines in FIG. 6. FIG. 7 shows that the sealing sheet 50 has been pierced over all the "morning" pill compartments 42 in sealed pill receptacle 78 to allow access to and change the pills P therein. It is noted that the substantially the entire to mouth opening of the pill compartments 42 where pills need to be changed have been cleared, i.e. the entire cover sheet member portions within third cutaway lines 64 have been removed. Thus, no undesirable flanges that might support and eventual overlying sealing sheet remain.

After having changed pills P in selected pill compartments 42, these pill receptacles 42 are to be sealed once again. This may be accomplished as shown in FIG. 7 by using a new cover sheet member 148 which is similar to the other cover sheet member 48 used to originally seal pill receptacle 36. The same reference numbers will be used in the present specification and drawings to identify the same structures on new cover sheet member 148 than on the original cover sheet member 48, except for the sheet itself (148). New cover sheet member 148 is printed with the appropriate updated data according to the modified medication doses.

As noted above, new cover sheet member 148 may be used to seal selected pill compartments 42 only, namely those pill compartments 42 over which the original cover sheet member 48 has been pierced. To install new cover sheet member 148, strip 65 is removed from the new cover sheet member 148 as suggested in FIG. 7 to have the thusly exposed surface of the sealing sheet adhesive surface 54 be applied and adhere to the marginal edge portion 36*a* of pill receptacle 36 which is covered by the original sealing sheet 50. This operation is facilitated by the alignment of new cover sheet member 148 with respect to sealed pill receptacle 78 which is obtained by installing sealed pill receptacle 78 on tray 22 with lugs 34 engaging holes 46; and then engaging the tray lugs 34 into the holes 70 of new cover sheet member 148.

According to the present invention, a fraction of new cover sheet member 148 is then separated from the rest the cover sheet member 148 along at least some of the first cutaway lines 60. In this particular example, the cover sheet member 148 is separated along the leftmost vertical first cutaway line 60; and along the topmost horizontal second cutaway line 62 from the leftmost vertical first cutaway line 60 to the right edge of the cover sheet member 148. This operation includes separating concurrently sealing sheet 50 and protective sheet 56 in registering fashion as far as the separation along first cutaway lines 60 is concerned, to form a cover sheet member fraction 80 which comprises a single column of cells that remains attached to the cover sheet member header portion 72. This column of cells corresponds to the "morning" doses. A disposable portion 82 of new cover sheet member 148 is defined by the columns of cells which are not desired and which may be disposed of as desired.

Having first cutaway lines 60 that extend through both sealing sheet 50 and protective sheet 56 allow a clean cut to be made when the cover sheet member fraction 80 is formed. This is important since an irregular tear may result in cover sheet member fraction 80 being undesirably torn within some cells 63, compromising the sealing capacity of cover sheet member fraction 80 over some pill compartments 42. Furthermore, an irregular tear may also result in sealing sheet 50 and protective sheet 56 tearing in non registering fashion, allowing some portions of sealing sheet adhesive surface 54 to become undesirably exposed and accidentally sticking to miscellaneous objects.

It is noted that cover sheet member fraction 80 may be formed by removing disposable portion 82 either after new cover sheet member 148 is attached to pill receptacle marginal edge portion 36*a*, or before it is attached thereto. In other words, it would also be possible to first detach and remove disposable portion 82, then remove protective strip 65 and apply the thusly exposed portion of adhesive surface 54 of cover sheet member fraction 80 to the pill receptacle marginal edge portion 36*a*.

The cover sheet member 148 separation along the topmost cutaway line 62 will not yield an irregular tear on protective sheet 56 since the fifth cutaway line 67, although not registering with topmost second cutaway line 62, is close enough that the separation will be possible. Furthermore, if protective strip 65 has been removed before the separation occurs, then sealing sheet 50 will constitute the only layer along topmost second cutaway line 62.

The fraction of protective sheet 56 on cover sheet member fraction 80 may be peeled away from the fraction of sealing sheet 50 to form a sealing sheet fraction that can be applied on the sealed pill receptacle 78 to cover and individually seal selected pill compartments 42, namely the "morning" column of pill compartments 42 in the present example. As with original cover sheet member 48, peeling the fraction of protective sheet 56 away from the fraction of sealing sheet 50 will expose the adhesive surface 54 of the fraction of sealing sheet 50 around protective tabs 76 that are formed concurrently within seventh cutaway lines 69. Access to protective sheet 56 on cover sheet member fraction 80 is made possible by lifting the column of cells while the cover sheet member fraction 80 remains attached to the pill receptacle marginal edge portion 36*a* over the cover original sheet 48. Once the serviceable sealing sheet fraction has been applied to the originally sealed pill receptacle 78, the latter may be removed from tray 22 and the sheet header portion 72 of the cover sheet member fraction 80 may be removed in which case the pill receptacle 36 will once again have all of its pill compartments 42 sealed with a single-layered cover sheet member 48, 80.

With the above-described method of sealing selected pill compartments 42, only the pill compartments 42 above which the sealing sheet 50 and protective tabs 76 were pierced will be covered by a new cover sheet member fraction 80. This is important since the other pill compartments 42 also maintain a single cover sheet member 48 covering them; and as a consequence all pill compartments 42 of the sealed pill receptacle 78 will be covered by a single one among cover sheet members 48, 80. This allows easy access to pill compartments 42 for the users who do not have to pierce two layers of cover sheets.

Also, by providing third cutaway lines 64 that allow the cover sheet members 48, 80 to be pierced along the contour of an underlying pill receptacle 42, the pharmacist changing pills P in a pill receptacle 42 can remove most if not all of the portions of original cover sheet member 48 that covers a particular pill compartment 42. This is advantageous in that the cover sheet member fraction 80 that will be installed over the selected pill compartments 42 where pills were changed, will not be significantly supported or reinforced by underlying flanges of the cover sheet member 48. This contributes to facilitating access to the pill compartments 42 where pills were changed.

Furthermore, the addition of a new column of cells 63 that are part of the cover sheet member fraction 80 to the sealed pill receptacle 78 will constitute an almost invisible re-sealing of pill receptacle 78. Indeed, by having previously reprinted the required information on the new cover sheet member 148, the latter will be essentially identical to the original cover sheet member 48. By applying a column of cells that are part of the cover sheet member fraction 80 over the originally sealed pill receptacle 78, only close and meticulous inspection will reveal that the pill compartments were pierced and re-sealed. Consequently, the user's and the medical staffs confidence in the product will be increased significantly with this method.

One particularly advantageous feature of the present invention resides in the disposition and configuration of the cutaway lines on the cover sheet member. More particularly, in the field of the present invention, it was considered contrary to the accepted practice to provide cutaway lines that extend through both the sealing sheet and the protective sheet, except for the very short cutaway lines that are provided centrally over each pill compartment to facilitate piercing through the sheet when access to the pill compartments is desired. Otherwise, cutaway lines will be made solely on the sealing sheet or the protective sheet, but no cutaway line will be made to register on both. Indeed, if cutaway lines of substantial length are made through both the sealing sheet and the protective sheet, then it is considered that the structural integrity of the cover sheet member will be compromised. The cover sheet member may accidentally tear along one or more cutaway lines when it is manipulated, especially when the cover sheet member is sent through an office printer for printing information on the sealing sheet identification surface 52.

The cover sheet member 48, 148 of the present invention includes first cutaway lines 60 that extend through both sealing sheet 50 and protective sheet 56. However, it has been noted that the structural integrity of the latter is not compromised even if these cutaway lines do exist. It may help that first cutaway lines 60 only extend from the bottom edge of cover sheet member 48, 148 to the uppermost second cutaway line 62, short of the upper edge of the cover sheet member 48, 148. In any event, first cutaway lines 60 allow for a cover sheet member fraction 80 to be separated from the rest of the cover sheet member without compromising its structural integrity when it is in its whole, non-fragmented state.

Cover sheet member 48, 148 and the method of sealing selected pill compartments 42 with cover sheet member 48, 148 is thus an important improvement over prior art methods of re-sealing pill compartments 42 as described in the Background of the Invention section. All the drawbacks of the prior art methods are circumvented as detailed hereinabove.

It is noted that pill receptacle 36 may be provided with weakness zones in the form of receptacle cutaway lines 84 (FIG. 2) that extend horizontally and vertically along the coplanar edges 39 of the top mouth openings of pill compartments 84. Receptacle cutaway lines 84 allow individual pill compartments 42 to be separated from the rest of pill receptacle by shearing off one or more (usually a single) pill compartment 42 from the rest of pill receptacle 36. The first and second cutaway lines 60, 62 of cover sheet member 48, 148 of the present invention are arranged to coincide with the position of the receptacle cutaway lines 84 so that sealing sheet 56 will tear cleanly when a pill compartment 42 is removed from the rest of pill receptacle 36. Since the protective sheet 56 has been peeled away in all positions that register with the receptacle cutaway lines 84 when pill receptacle 36 is sealed, protective sheet 56 will not be a factor in this operation.

In an alternate embodiment of the invention, it could be envisioned to use a sheet that has not header portion 72, although it is helpful for identification, alignment and structural integrity purposes as detailed hereinabove.

The cover sheet member 48, 148 described hereinabove is also advantageous in that it is can be used both whole 48 to cover the entire pill receptacle, or it can be fragmented to remove a disposable portion 82 thereof so that only a cover sheet member fraction 80 is used to cover selected pill compartments 42. It is further noted that it is not mandatory to apply cover sheet member fraction 80 to a pre-sealed pill receptacle where some pill compartments 42 have been accessed; cover sheet member fraction 80 could be used to initially seal selected pill compartments 42 only of a pill receptacle where not all pill compartments are to be sealed.

Any further modification which is considered obvious to someone skilled in the art is considered to be included within the scope of protection of the present invention, as further defined in the appended claims.

The invention claimed is:

1. A cover sheet member for use with a pill receptacle having a number of recessed pill compartments, said cover sheet member defining peripheral edges and comprising:

a sealing sheet with a top identification surface on which information can be printed and a bottom adhesive surface provided with an adhesive;

a protective sheet which overlays said sealing sheet on its adhesive surface;

first weakness zones that extend transversely through said sealing sheet and said protective sheet in a registering fashion to define first cutaway lines that are parallel to one another;

second weakness zones that extend transversely through said sealing sheet but not through said protective sheet to define second cutaway lines that are parallel to one another; wherein said first and second cutaway lines intersect and are disposed perpendicularly to form rows between consecutive said second cutaway lines and between some of said second cutaway lines and some of said cover sheet member peripheral edges; and columns between consecutive said first cutaway lines and between some of said first cutaway lines and some of said cover sheet member peripheral edges; wherein said protective sheet is peeled away from said sealing sheet for applying said sealing sheet on said pill receptacle to cover and individually seal said number of pill compartments; and wherein a fraction of said cover sheet member is adapted to be separated from the rest of said cover sheet member along at least some of said first cutaway lines, including concurrently separating corresponding fractions of said sealing sheet and said protective sheet in registering fashion, whereby said protective sheet fraction is peeled away from said sealing sheet fraction on said cover sheet member fraction for applying said sealing sheet fraction on said pill receptacle for covering and individually sealing selected ones of said number of pill compartments.

2. A cover sheet member as defined in claim 1, further comprising third weakness zones on said cover sheet member each located within said rows and columns, said third weakness zones defining third cutaway lines forming closed loops.

3. A cover sheet member as defined in claim 2, wherein said third weakness zones further include a pair of fourth cutaway lines located within said closed loops formed by said third cutaway lines.

4. A cover sheet member according to claim 2, wherein said first and third weakness zones include perforations that extends through both said sealing sheet and said protective sheet and said second weakness zones include perforations that extend through said sealing sheet but not through said protective sheet.

5. A cover sheet member according to claim 1, further comprising a header portion separated from said first cutaway lines by one of said second cutaway lines and being circumscribed by said one of said second cutaway lines and by at least some of said cover sheet member peripheral edges.

* * * * *